United States Patent [19]

Wong et al.

[11] Patent Number: 4,970,480

[45] Date of Patent: Nov. 13, 1990

[54] MICROWAVE DIPLEXER

[75] Inventors: Mon N. Wong, Torrance; Gregory D. Kroupa, Hawthorne; Thomas F. Foster, Jr., Los Angeles, all of Calif.

[73] Assignee: Hughes Aircraft Company, Los Angeles, Calif.

[21] Appl. No.: 364,766

[22] Filed: Jun. 9, 1989

[51] Int. Cl.[5] ..... H01P 1/209

[52] U.S. Cl. ..... 333/135; 333/212

[58] Field of Search ..... 333/126, 129, 132, 134, 333/135, 210, 212

[56] References Cited

U.S. PATENT DOCUMENTS

| | | | |
|---|---|---|---|
| 3,587,008 | 6/1971 | Tsuda | 333/212 |
| 4,498,062 | 2/1985 | Massaglia et al. | 333/135 |
| 4,837,531 | 6/1989 | Gourlain et al. | 333/135 |

FOREIGN PATENT DOCUMENTS

| | | | |
|---|---|---|---|
| 07654 | 1/1977 | Japan | 333/126 |

*Primary Examiner*—Paul Gensler

[57] ABSTRACT

A diplexer for electromagnetic signals of higher and lower frequency is formed of a common waveguide channel for both signals, the common channel branching into a through waveguide channel and a side waveguide channel. The through channel includes a filter having a pass band for propagation of the lower frequency signal and inhibiting propagation of the higher frequency signal. The side channel is formed as a waveguide below cut-off frequency with respect to the lower frequency signal for inhibiting propagation of the lower frequency signal while permitting propagation of the higher frequency signal. A coupling aperture formed as a slot resonant at the higher frequency is located in a waveguide wall at an integral number of quarter guide wavelengths in front of the filter for coupling the higher frequency signal between the common and the side channels.

5 Claims, 2 Drawing Sheets

MICROWAVE DIPLEXER

BACKGROUND OF THE INVENTION

This invention relates to a microwave diplexer providing separate propagation paths to electromagnetic radiations of two different frequencies and, more particularly, to a diplexer having one branch constructed as a waveguide below cutoff to radiation at a lower of the two frequencies while passing radiation at a higher of the two frequencies, and having a second branch with a band pass filter for allowing propagation of the lower frequency radiation while inhibiting propagation of the higher frequency radiation.

Microwave diplexers are employed in circuits handling signals at more than one frequency band. A typical circuit is found in a communication system such as a broadcast system employing a satellite for retransmission of radio and television signals. The satellite carries an antenna with a feed structure that illuminates the antenna, or receives from the antenna, signals at different frequencies. A diplexer couples the feed structure to transceivers operating at the different frequencies.

Generally speaking, the diplexer may be described as having three branches, or channels, which are constructed of waveguide. These branches are a common branch operative at both the higher and the lower frequencies to couple electromagnetic power between the antenna and the two transceivers. The common channel branches into a through channel and a side channel which are operative to separate microwave signals at the two frequencies. The through channel connects with circuitry such as a receiver or transceiver operative at one frequency, while the side channel connects with circuitry such as a receiver or transceiver operative at the other frequency.

The diplexer is usually constructed with tuned elements in both the through and the side channels to form filters in these channels so that each of these two channels propagates radiation at only one of the two frequency bands while inhibiting propagation at the other of the frequencies. Thereby, the diplexer can separate incoming signals at the two frequency bands, and can couple outgoing signals at the two frequency bands to a common feed of the antenna.

A problem arises in that the construction of a diplexer with filters of discrete microwave elements in two of the branches adds undue complexity to the manufacturing process, and may also prevent a minimizing of the physical size of the diplexer.

SUMMARY OF THE INVENTION

The aforementioned problems are overcome and other advantages are provided by a microwave diplexer constructed in accordance with the invention, the diplexer comprising a first section of waveguide and a second section of waveguide joining the first section. The first section serves as a common channel of the diplexer and terminates in a common port for propagation of radiation at the two frequency bands. The second section serves as a through channel of and terminates in a through port for propagation of radiation at the lower frequency.

A third section of waveguide joins the first section of waveguide, the third section serving as a side channel of the diplexer and terminates in a side port for propagation of radiation at the higher frequency. A filter is provided in the through channel for inhibiting a propagation of the higher frequency radiation while permitting propagation of the lower frequency radiation. The filter is constructed of a series of two or more inductive irises spaced apart by one or more resonant cavities.

The side channel is provided, in at least a portion thereof, with cross-sectional dimensions large enough to sustain a propagating mode of the higher frequency radiation and small enough to provide an evanescent mode for the lower frequency radiation to inhibit propagation of the lower frequency radiation. There is a coupling aperture in a broad wall of the first waveguide section for coupling radiation from the common channel to the side channel. The aperture is configured as a slot resonant at the higher frequency. A first of the filter irises closest the coupling aperture is located an odd number of one-quarter guide wavelengths at the higher-frequency radiation from the coupling aperture to reflect the higher frequency radiation back to the coupling aperture with a maximum value of electric field at the coupling aperture to maximize propagation of the higher frequency radiation between the common channel and the side channel.

BRIEF DESCRIPTION OF THE DRAWING

The aforementioned aspects and other features of the invention are explained in the following description, taken in connection with the accompanying drawing wherein.

DETAILED DESCRIPTION

Figure 1:
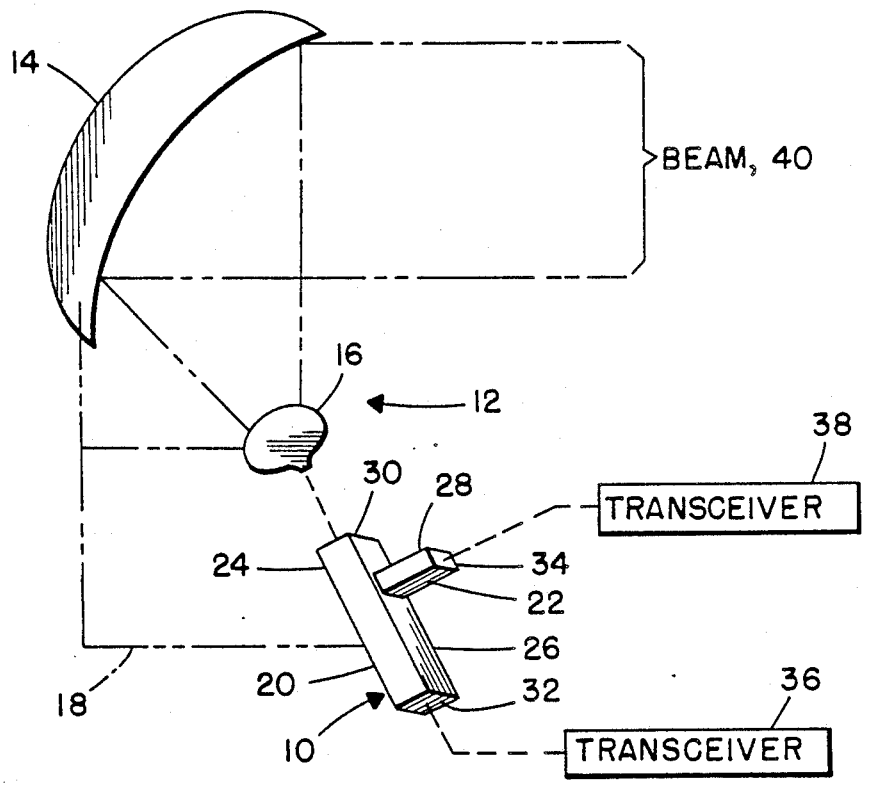
FIG. 1 shows a stylized view of the diplexer of the invention employed, by way of example, in the coupling of microwave signals between an antenna and two transceivers as in a satellite communication system.

With reference to FIG. 1, there is shown a diplexer 10, constructed in accordance with the invention and being suitable for use with microwave circuitry in the processing of electromagnetic signals. By way of example in the use of the diplexer 10 in a satellite communication system, the diplexer 10 is employed with an antenna 12 having a reflector 14 and a feed 16. The diplexer 10, the feed 16 and the reflector 14 are supported by a support 18, indicated in phantom, which support may be a satellite circumnavigating the earth for use in a communication system. The diplexer 10 is constructed of a waveguide 20 with a section 22 of waveguide extending from the side of the waveguide 20 to form three channels, namely, a common channel 24, a through channel 26 and a side channel 28. The three channels terminate respectively in three ports, namely, a common port 30, a through port 32 and a side port 34. The through port 32 and the side port 34 are connected, by way of example, to transceivers 36 and 38. The common port 30 is connected to the feed 16 for transmission of signals from the transceivers to the reflector 14 to form a beam 40 of radiation.

Figure 2:
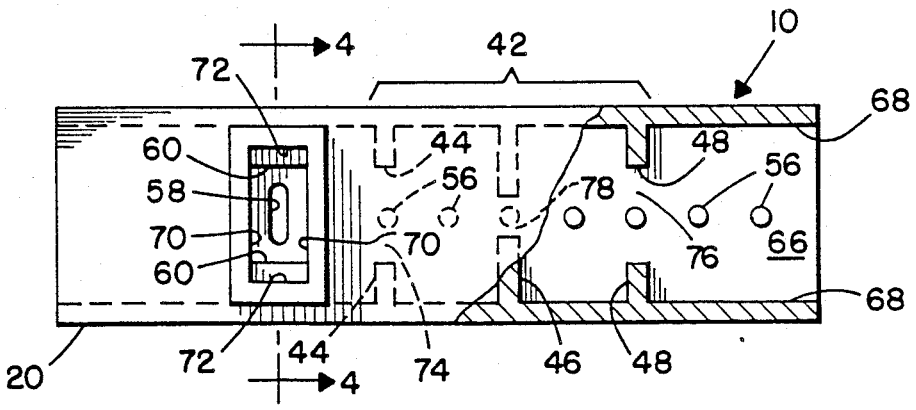
FIG. 2 is a top plan view of the diplexer with a portion of a top broad wall of a waveguide cut away to disclose construction of a filter.
Figure 3:
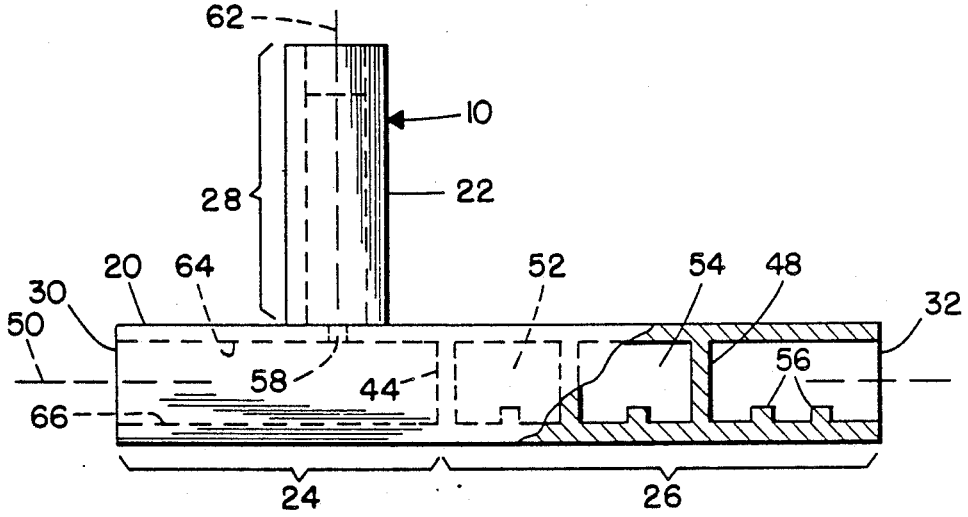
FIG. 3 is an elevation view of the diplexer with a portion of a sidewall of a waveguide cut away to disclose construction of the filter.
Figure 4:
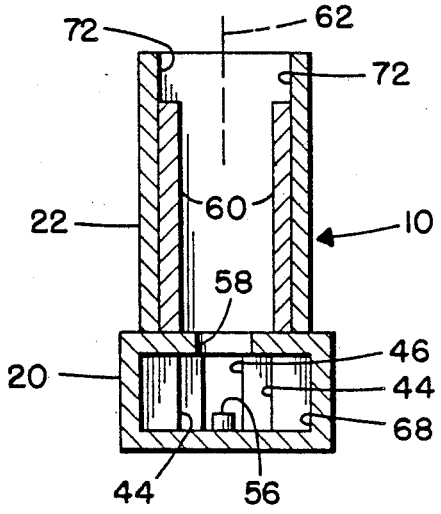
FIG. 4 is a sectional view of the diplexer taken along the line 4—4 in FIG. 2.

With reference also to FIGS. 2, 3 and 4, the diplexer 10 further comprises a filter 42 which is formed of three inductive irises 44, 46 and 48 which are spaced apart along an axis 50 of the waveguide 20 to define a series of two cavities 52 and 54 of the filter 42. Capacitive tuning screws 56 are provided for tuning the filter 42. Also included in the diplexer 10 is a coupling aperture in the form of a resonant slot 58 for coupling electromagnetic energy between the side channel 28 and a first section of the waveguide 20. The first section of the waveguide 20 extends from the common port 30 to a first one of the irises, namely the iris 44, the first section being co-terminous with the common channel 24. A second section of the waveguide 20 extends from the first iris 44 to the through port 32 and houses the filter 42, the second section being co-terminous with the through channel 26. Two shims 60 are located in the waveguide section 22 at opposite ends of the slot 58 and are disposed parallel to an axis 62 of the waveguide section 22.

The waveguide 20 comprises a broad top wall 64 and an opposed broad bottom wall 66 which are joined by narrow sidewalls 68 to provide a rectangular cross section to the waveguide 20. In a preferred embodiment of the invention, the ratio of the widths of the broad top wall 64 to a sidewall 68 is 2:1. The waveguide section 22 comprises broad walls 70 which are joined by narrow sidewalls 72 to provide a rectangular cross section to the waveguide section 22. In a preferred embodiment of the invention, the ratio of the widths of a broad wall 70 to a sidewall 72 is 2:1.

The slot 58 passes through the top wall 64, is located symmetrically about the axis 62, and extends in its longitudinal dimension parallel to the broad wall 70 of the waveguide section 22 and perpendicular to the sidewalls 68 of the waveguide 20. The perimeter of the slot 58 is equal to one free-space wavelength at the center of the band of radiation to be coupled by the slot 58 between the channels 24 and 28. The center of the slot 58 is located between the first iris 44 and the common port 30 at distance equal to an odd number of one-quarter guide wavelengths, preferably one-quarter guide wavelength, from the iris 44.

In the filter 42, the irises 44, 46 and 48 extend from the top wall 64 to the bottom wall 66, and abut the sidewalls 68. The outermost irises 44 and 48 define apertures 74 and 76, respectively, which are of equal width and are wider than the aperture 78 defined by the central iris 46. If the filter 42 were constructed with only one cavity, then there would be only two irises defining equal apertures. If the Filter 42 were constructed with three or more cavities, then there would be additional irises with varying aperture sizes symmetrically positioned about a center of the filter, the aperture sizes narrowing toward the center of the filter. The filter 42 is constructed in accordance with well known technology to provide a pass band at the microwave frequencies which are to propagate via the through channel 26, and to provide a stop band at the microwave frequencies which are to propagate via the side channel 28. The tuning screws 56 are located along the center of the bottom wall 66 and penetrate into the waveguide 20 a relatively small distance, typically less than ten percent of the distance between the broad walls 64 and 66.

In the operation of the preferred embodiment of the invention, the diplexer 10 operates at signal frequencies 12 and 14 GHz (gigahertz). Both signals propagate through the common channel 24. The lower frequency 12 GHz signal propagates in the through channel 26 centered in a pass band having a width of approximately 1.0 GHz provided by the filter 42. The higher frequency 14 GHz signal propagates in the side channel 28 centered in a pass band having a width of approximately 1.0 GHz provided by the slot 58. Operation of the diplexer 10 is reciprocal such that microwave signals can propagate in either direction between the ports 30 and 32, and between the ports 30 and 34. The waveguide 20 is fabricated of WR-75 waveguide having interior dimensions of 0.75 inch by 0.375 inch. The waveguide section 22 is fabricated of WR-62 waveguide having interior dimensions of 0.622 inch by 0.311 inch. The shims 60 are positioned contiguous the sidewalls 72, extend the full distance between the broad walls 70, and abut the top wall 64 of the waveguide 20. Each of the shims 60 has a length of 1.0 inch which is greater then the guide wavelength of the waveguide section 22 at 14 GHz.

The shims 60 reduce the distance between the sidewalls 72 to 0.460 inch resulting in a cutoff frequency of approximately 12.8 GHz in the region of the waveguide section 22 between the shims 60. In the filter 42, each of the cavities 52 and 54 extends along the waveguide axis 50 a distance of approximately 0.5 inch, this being slightly less than one-half the guide wavelength at 12 GHz, and functions as a resonator tuned to resonate at 12 GHz. The aperture of the iris 44 and of the iris 48 is 0.45 inch as measured in a direction parallel to the top wall 64. The aperture of the iris 46 is 0.25 inch. The higher frequency 14 GHz signal is attenuated sufficiently by the filter 42 so that, as a practical matter, the higher frequency signal may be regarded as not propagating through the filter 42. The cross-sectional dimensions of the waveguide section 22 within the region of the shims 60 are large enough so as to allow propagation of the higher frequency signal. The cross-sectional dimensions of the shim region are too small to sustain a propagating mode at the lower 12 GHz frequency, and provide for an evanescent mode which severely attenuates the lower frequency signal so that, as a practical matter, the lower frequency signal may be regarded as not propagating in the waveguide section 22.

The first iris 44 reflects the higher frequency signal back towards the common port 30 to produce a standing wave having a maximum value of electric field one-quarter guide wavelength in front of the first iris 44. The placement of the slot 58 one-quarter guide wavelength at the higher frequency in front of the first iris 44 maximizes coupling of the higher frequency signal via the slot 58 between the common channel 24 and the side channel 28. The aforementioned bandwidth at the higher frequency signal is dependent of the dimensions of the slot 58, a narrower slot providing a narrower bandwidth. The length of the slot 58 is 0.42 inch, this being approximately one-half the free-space wavelength at the higher frequency. The width of the slot 58 is 0.040 inch. If desired, the slot width may be enlarged to 0.060 inch or decreased to 0.030 inch to increase or decrease the bandwidth of the signals coupled between the common and the side channels.

The microwave signals at both frequency bands are transverse electric signals TE10 with the electric vector being perpendicular to the broad walls 64 and 66 in the waveguide 20, and perpendicular to the broad walls 70 in the waveguide section 22. In the slot 58 the electric field extends across the slot perpendicular to the long sides of the slot. The overall length and width of the diplexer 10 measure 3.5 inch by 1.7 inch. Thus, the diplexer of the invention has a compact structure which is simpler and more readily manufactured than other diplexers heretofore.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A microwave diplexer comprising:

a first section of waveguide and a second section of waveguide joining said first section, said first section serving as a common channel of said diplexer and terminating in a common port for propagation of radiation at two frequencies of which one frequency is higher than the other frequency, said second section serving as a through channel of said diplexer and terminating in a through port for propagation of radiation at a lower frequency of said two frequencies;

a third section of waveguide joining said first section of waveguide, said third section serving as a side channel of said diplexer and terminating in a side port for propagation of radiation at a higher frequency of said two frequencies;

filter means in said through channel for inhibiting a propagation of radiation at said higher frequency while permitting propagation of the lower frequency radiation; and wherein at least a portion of said side channel has cross-sectional dimensions large enough to sustain a propagating mode of the higher frequency radiation and small enough to provide an evanescent mode for the lower frequency radiation to inhibit propagation of the lower frequency radiation;

each of said sections of waveguide has a rectangular cross-section and comprises two opposed broad walls joined by two opposed sidewalls which are narrower than said broad walls, said side channel joining said common channel at a first broad wall of said first waveguide section for supporting a transverse electric mode of radiation in each of said waveguide sections with electric field parallel to a sidewall, there being a coupling aperture in said first broad wall for coupling radiation from said common channel to said side channel;

the aperture in said first broad wall is formed as an elongated resonant slot having a perimeter approximately equal to one free-space wavelength of the higher frequency radiation, a longitudinal axis of the slot extending in a direction perpendicular to the sidewalls of said first and said second waveguide sections; and wherein said filter means comprises a plurality of inductive irises spaced apart along said second waveguide section to define at least one cavity resonant with the irises at the lower frequency to provide a pass band for propagation of the lower frequency radiation, a first of said irises closest said coupling aperture being located an odd number of one-quarter guide wavelengths at the higher-frequency radiation from said coupling aperture to reflect the higher frequency radiation back to the coupling aperture with a maximum value of electric field at the coupling aperture to maximize propagation of the higher frequency radiation between said common channel and said side channel, wall elements of said first iris extending inwardly of the sidewalls of said through channel a sufficient distance to define a slot width of said first iris equal to approximately one-half wavelength of the higher frequency radiation for reflecting the higher frequency radiation back to the coupling aperture, thereby to minimize the physical size of the microwave diplexer.

2. A diplexer according to claim 1 wherein said filter means comprises a plurality of said cavities, one of said irises which is centrally located among said cavities having a slot of narrower width than a slot of said first iris, there being capacitive tuning screws in a broad wall of said second waveguide section for tuning said filter means.

3. A diplexer according to claim 1 wherein said portion of said side channel is reduced in cross-section by reduction of the width of the broad walls of said third waveguide section at said portion to inhibit propagation of the lower frequency radiation.

4. A diplexer according to claim 1 further comprising shims disposed in said portion of said side channel alongside sidewalls thereof to reduce the cross-section of said portion of said side channel to inhibit propagation of the lower frequency radiation.

5. A microwave diplexer comprising:

a first section of waveguide and a second section of waveguide joining said first section, said first section serving as a common channel of said diplexer and terminating in a common port for propagation of radiation at two frequencies of which one frequency is higher than the other frequency, said second section serving as a through channel of said diplexer and terminating in a through port for propagation of radiation at a lower frequency of said two frequencies;

a third section of waveguide joining said first section of waveguide, said third section serving as a side channel of said diplexer and terminating in a side port for propagation of radiation at a higher frequency of said two frequencies;

filter means in said through channel for inhibiting a propagation of radiation at said higher frequency while permitting propagation of the lower frequency radiation, there being a coupling aperture at a junction of said third section and said first section of waveguide for coupling radiation from said common channel to said side channel; and wherein said coupling aperture is formed as an elongated resonant slot having a perimeter approximately equal to one free-space wavelength of the higher frequency radiation, a longitudinal axis of the resonant slot extending in a direction perpendicular to a longitudinal axis of said third section of waveguide and perpendicular to a longitudinal axis of said first section of waveguide;

said filter means comprises a plurality of inductive irises spaced apart along said second waveguide section to define at least one cavity resonant with the irises at the lower frequency to provide a pass band for propagation of the lower frequency radiation, wall elements of a first of said irises closes said coupling aperture extending towards a center of said through channel a sufficient distance to define a slot width of said first iris equal to approximately one-half wavelength of the higher-frequency radiation for reflecting the higher frequency radiation back to said coupling aperture, said first iris being located an odd number of one-quarter guide wavelengths at the higher-frequency radiation from said coupling aperture to reflect the higher-frequency radiation back to said coupling aperture with a maximum value of electric field at the coupling aperture to maximize propagation of the higher-frequency radiation between said common channel and said side channel; and at least a portion of said side channel has cross-sectional dimensions large enough to sustain a propagating mode of the higher-frequency radiation and small enough to provide an evanescent mode for the lower-frequency radiation to inhibit propagation of the lower-frequency radiation, thereby to minimize the physical size of the microwave diplexer.

* * * * *